US006910464B2

(12) United States Patent
Ishikawa et al.

(10) Patent No.: US 6,910,464 B2
(45) Date of Patent: Jun. 28, 2005

(54) FUEL SUPPLY SYSTEM FOR VEHICLE

(75) Inventors: Osamu Ishikawa, Tokyo (JP); Shiro Yonezawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/914,127

(22) Filed: Aug. 10, 2004

(65) Prior Publication Data

US 2005/0045153 A1 Mar. 3, 2005

(30) Foreign Application Priority Data

Aug. 28, 2003 (JP) ..... P2003-304687

(51) Int. Cl.[7] ..... F02M 37/00
(52) U.S. Cl. ..... 123/458; 123/446; 123/497
(58) Field of Search ..... 123/497, 446, 123/447, 457, 458, 459, 467, 357

(56) References Cited

U.S. PATENT DOCUMENTS 5,398,655 A * 3/1995 Tuckey ..... 123/456
5,579,739 A * 12/1996 Tuckey et al. ..... 123/467
5,740,783 A * 4/1998 Learman et al. ..... 123/497
6,283,108 B1 * 9/2001 Matsufuji et al. ..... 123/690
6,357,423 B1 * 3/2002 Kanno ..... 123/497
6,367,455 B2 * 4/2002 Hirata et al. ..... 123/497
2003/0192508 A1 * 10/2003 Kishimoto ..... 123/447

FOREIGN PATENT DOCUMENTS

JP 11-315768 A 11/1999

* cited by examiner

*Primary Examiner*—Weilun Lo
(74) *Attorney, Agent, or Firm*—Sughrue Mion, PLLC

(57) ABSTRACT

A fuel supply system for a vehicle of the present invention includes a fuel pump, a fuel pressure regulator for controlling the fuel pressure in a fuel piping, and pump control means for operating the fuel pump at a given discharge amount by controlling/stopping the operation of the fuel pump by setting a DUTY drive signal supplied to the fuel pump control device to a predetermined DUTY when the output of a pressure detector for measuring the fuel pressure in the fuel piping reaches a first set pressure, and setting the DUTY drive signal according to the required amount of fuel discharge when the output of the pressure detector reaches a second set pressure.

6 Claims, 6 Drawing Sheets

FUEL SUPPLY SYSTEM FOR VEHICLE

BACKGROUND OF THE INVENTION

1. Field of the Invention

The present invention relates to a fuel supply system for a vehicle and, more specifically, to a fuel supply system for a vehicle which can reduce fuel consumption of a vehicle engine.

2. Description of the Related Art

FIG. 7 to FIG. 9 show a fuel supply system for a vehicle disclosed in United States Patent application preceding to the application of the invention (U.S. Ser. No. 10/391,614, filing date: Mar. 20, 2003, hereinafter simply referred to as "precedent application".).

In FIG. 7, a fuel pump 1 includes a pump body 1*a*, an electric motor unit 1*b* for driving the pump body 1*a*, and a check valve 1*c* for enhancing startability of the engine by filling a fuel system including a fuel piping 3 when an engine 5 is stopped, described later, with fuel, and is disposed in a fuel tank 2. The fuel pump 1 is connected to a fuel pressure regulator 7 for controlling the fuel pressure in the fuel piping to a predetermined controlled pressure via the fuel piping 3, a pressure accumulator 30 for accumulating the pressure of the fuel pumped into the fuel piping 3, a pressure detector 22 for measuring the fuel pressure in the fuel piping 3, and a fuel injection valve 4.

The fuel injection valve 4 is connected to an intake pipe 6 of the engine 5, and is adapted to be controlled by the engine control unit 20 and to supply fuel to the engine 5.

A switch relay 21 is controlled to stop power distribution to the motor unit 1*b* of the fuel pump 1 from a power source E by opening a contact point 21*a* when the pressure in the fuel piping 3 reaches a first set pressure P1 by a pump control unit 20*a* of the engine control unit 20, and start power distribution to the motor unit 1*b* by turning the contact point 21*a* on when the pressure in the fuel pump 3 is reduced to a second set pressure P2 which is lower than the first set pressure P1.

The fuel pressure regulator 7 includes a spring chamber 8 and a pressure regulating chamber 9 divided by a diaphragm 10. A spring 8*a* is disposed in the spring chamber 8 so that the spring 8*a* presses the diaphragm 10 at a predetermined control pressure toward the pressure regulating chamber 9.

The pressure regulating chamber 9 includes a discharge port 9*a* and a valve member 9*b* mounted to the diaphragm 10 for opening and closing the discharge port 9*a*. The spring chamber 8 is brought into communication with the upstream side of the fuel injection valve 4 in the intake pipe 6 via a branch piping 11*a*, and the pressure regulating chamber 9 is brought into communication with the fuel piping 3 via a branch piping 11*b*. In addition, the pressure regulating chamber 9 is brought into communication with the fuel tank 2 via the discharge port 9*a* and a return piping 12.

The engine control unit 20 includes the pump control unit 20*a* and a fuel calculation control unit 20*b*, and the fuel calculation control unit 20*b* calculates the required amount of fuel supply based on the air quantity sucked by the engine 5, with the premise that the pressure difference between the front and the back of the fuel injection valve 4 is kept constant, and the valve opening time of the fuel injection valve 4 is controlled. In this case, as a method of calculating the required amount of fuel supply to the engine 5 by the fuel calculation control unit 20*b*, so-called a D-jetronic system, which calculates the required amount of fuel supply based on the pressure in the intake pipe 6 measured directly by an intake pipe pressure detector 14, is employed. However, it is also possible to employ a L-jetronic system in which an airflow sensor is mounted to the intake pipe 6 to calculate the required fuel amount based on the intake air amount per unit time of the engine 5 detected by the airflow sensor instead of the intake pipe pressure detector 14.

The pressure accumulator 30 is disposed so as to communicate with the fuel piping 3 as shown in an enlarged view in FIG. 8 and a detailed view of a diaphragm in FIG. 9, and includes a storage chamber 32 adapted to be filled with fuel flown from the fuel piping 3 and expand or contract in the direction of center axis depending on the fuel pressure to vary the capacity.

The storage chamber 32 includes a cylindrical diaphragm 33 formed of nitrile butadiene rubber (NBR) into an accordion shape, a metallic ring 34 of stainless steel embedded in the diaphragm 33 at a predetermined position, and an end plate 35 of a disk shape mounted hermetically at the other end (lower end in FIG. 8, FIG. 9) of the diaphragm 33, and an end (upper end in FIG. 8, FIG. 9) of the diaphragm 33 is hermetically mounted to an inner wall of an enclosure 31 so that the metallic ring 34 is integrally molded when molding the diaphragm.

The storage chamber 32 is adapted to contract in the process of lowering of the fuel pressure in the fuel piping 3 from a third set pressure P3, which is at least lower than the first set pressure P1 and a predetermined control pressure of the fuel pressure regulator, and higher than the second set pressure P2 to the second set pressure P2 to hold a pressurizing force for delivering the fuel in the storage chamber 32 to the fuel piping 3. The pressure accumulator 30 is disposed in an engine room, in a fuel pressure regulator, or in the fuel tank, although it is not shown.

Since the fuel supply system for a vehicle in the precedent application is configured as shown above, and hence the pressure accumulator 30, which communicates with the fuel piping 3 and is filled with fuel flown from the fuel piping, is disposed in the engine room, in the fuel pressure regulator, or in the fuel tank, there was a problem in that it was necessary to secure a space for disposing the pressure accumulator 30 therein and hence the manufacturing cost increases.

Also, since the pressure accumulator 30 has a complex structure as described above, when disposing the pressure accumulator 30 in the engine room, in the fuel pressure regulator, or in the fuel tank, there was a problem in that a significant cost was required for devising a countermeasure for deterioration of a movable portion due to vertical vibrations during normal travel or a countermeasure for enhancement of the durability for the case of collision.

In addition, in the fuel pump control means in the precedent application, since the fuel pump 1 is driven by an ON/OFF signal, fuel is discharged at a maximum capacity from the fuel pump 1 while ON signal is emitted. Therefore, there was a problem in that after the fuel pressure reaches the first set pressure P1 and then the pump is stopped, fuel continues to flow back to the fuel tank 2 uselessly for a while due to inertia of the motor unit 1*b* of the fuel pump 1.

Also, in the fuel pressure correcting means of the precedent application, the valve opening period of the fuel injection valve 4 is controlled so that the amount of fuel supply calculated based on the output of the fuel pressure detector can be obtained for each calculation cycle of the fuel calculation control unit of the engine control unit. Therefore, there was a problem in that when the fuel pressure in the fuel piping 3 varies for a shorter time than the calculation cycle, time lag may occur for the control of the valve opening period of the fuel injection valve 4.

Furthermore, in the fuel pressure regulator 7 in the precedent application, since the fuel discharge port 9*a* on the upstream of the return piping 12 is constantly opened, there was also a problem in that when the fuel pressure exceeds the control pressure of the fuel pressure regulator at the time when the fuel pump 1 is driven, an useless fuel flowback occurs.

SUMMARY OF THE INVENTION

In order to solve the problems described above, it is an object of the invention to provide a fuel supply system for a vehicle in which unnecessary fuel flow back due to inertia of the pump after the fuel pump is stopped can be minimized.

An fuel supply system for a vehicle according to the invention includes a fuel pump for pumping fuel in a fuel tank to a fuel injection valve via a fuel piping including a check valve, a fuel pressure regulator connected to the fuel piping for controlling the fuel pressure in the fuel piping to a predetermined control pressure, a pressure detector for measuring the fuel pressure in the fuel piping, and pump control means for controlling or stopping the operation of the fuel pump by setting a DUTY drive signal supplied to a fuel pump control device to a predetermined DUTY when the output of the pressure detector reaches a first set pressure P1 and setting a DUTY drive signal supplied to the fuel pump control device to DUTY according to the required amount of fuel discharge when the output of the pressure detector is lowered to a second set pressure P2 which is lower than the first set pressure P1 and the predetermined control pressure of the fuel pressure regulator, so that the fuel pump is driven by a given discharge amount.

In this arrangement, according to the fuel supply system for a vehicle of the invention, since unnecessary fuel flow back due to inertia of the pump after the fuel pump is stopped can be minimized, unnecessary fuel discharge from the pump is reduced, whereby an inexpensive fuel supply system for a vehicle in which power loss is reduced can be obtained.

According to the invention, since pump control means which can control arbitrary by supplying a given DUTY drive signal from the engine control device to the fuel pump control unit is provided, a fuel pressure overshoot or fuel pressure pulsation, which is generated when a fuel flow back port is closed, may be reduced.

In addition, since the pressure accumulator in the related art is not necessary, it is not necessary to provide a space for disposing the pressure accumulator in an engine room, in a fuel pressure regulator, or in a fuel tank.

Since the pressure accumulator in the related art is not necessary, it is not necessary to devise a countermeasure for deterioration of the movable portion due to vertical vibrations during the normal travel in cooperation with the disposition of the pressure accumulator or a countermeasure for enhancement of durability for the case of collision.

DESCRIPTION OF THE PREFERRED EMBODIMENTS

First Embodiment

Figure 1:
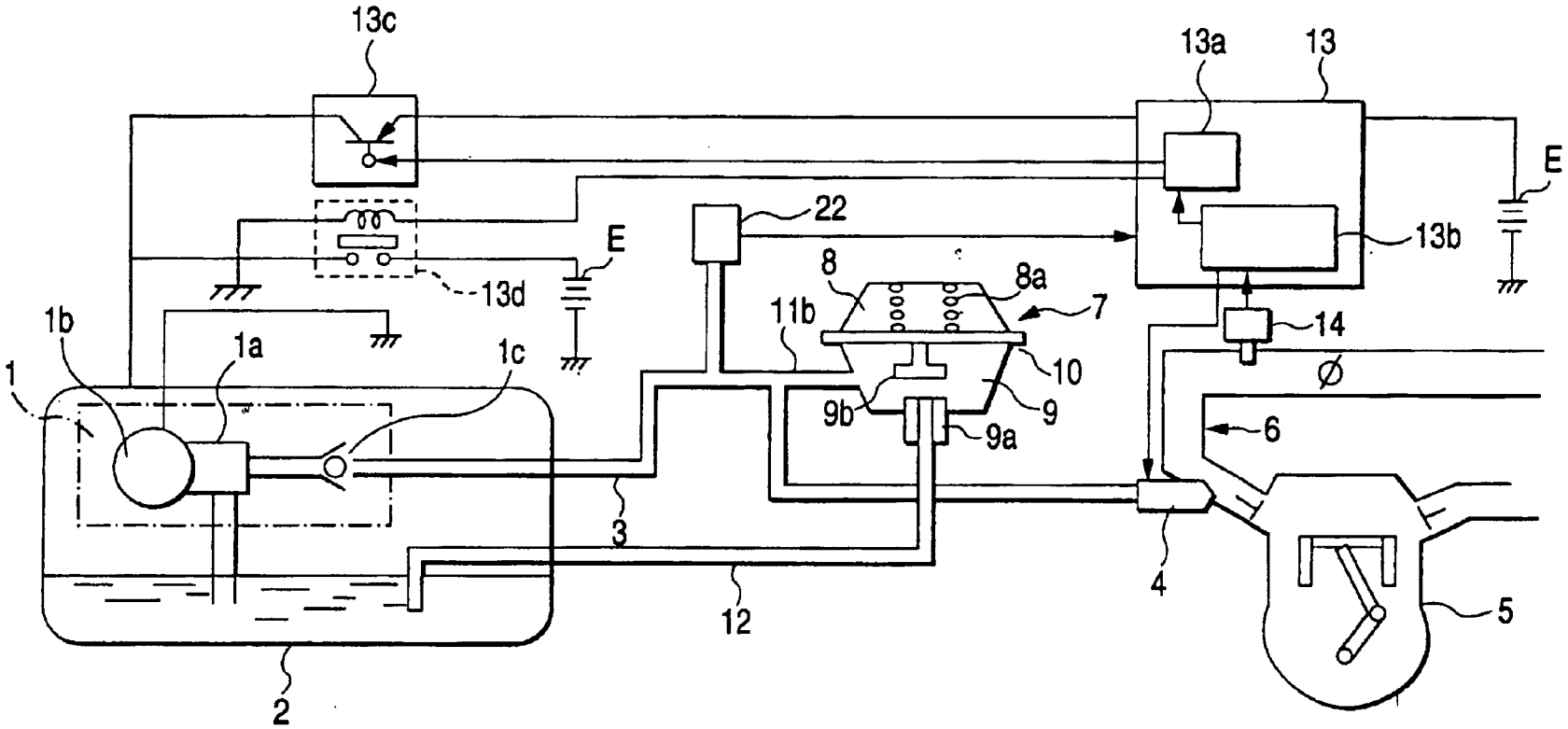
FIG. 1 is a system diagram showing an entire structure of a fuel supply system for a vehicle according to a first embodiment of the invention.

Referring now to the drawings, a first embodiment of the invention will be described.

FIG. 1 is a system diagram showing an entire structure of a fuel supply system for a vehicle according to a first embodiment.

In this drawing, an engine control unit 13 includes a pump control unit 13*a*, and a fuel calculation control unit 13*b*. A fuel pressure detector 22 is connected to a fuel piping 3 for detecting the pressure of fuel in the fuel piping 3 and supplying a pressure detection signal to the engine control unit 13. A fuel pressure regulator 7 is connected to the fuel piping 3 via a branch piping 11*b*, and includes a spring chamber 8 and a pressure regulating chamber 9 to which fuel in the fuel piping 3 is introduced via a branch piping 11*b*.

When a predetermined control pressure controlled by a set spring force of the spring 8*a* exceeds the pressure in the pressure regulating chamber 9, a diaphragm 10 is pressed toward the pressure regulating chamber 9, and a valve body 9*b* mounted to the diaphragm 10 closes a discharge port 9*a*. When the set spring force of the spring 8*a* under runs the pressure in the pressure regulating chamber 9, the diaphragm 10 is pressed toward the spring chamber 8 and the valve body 9*b* moves apart from the discharge port 9*a*, so that fuel from the fuel piping 3 is flown back to a fuel tank 2 via the discharge port 9*a* and a return piping 12.

The engine control unit 13 calculates a required amount of fuel supply based on the air quantity which is sucked by an engine 5 from an intake pipe 6 by the fuel calculation control unit 13*b* and controls the valve-opening period of a fuel injection valve 4. Also, the engine control unit 13 is adapted to turn a fuel pump control unit 13*c* OFF by a pump control unit 13*a* when the pressure in the fuel piping 3 reaches a first set pressure P1 to stop power distribution to a motor unit 1*b*, and to turn the fuel pump control unit 13*c* ON to start power distribution at a given power to the motor unit 1*b* when the pressure in the fuel piping 3 becomes a second set pressure P2 by the pump control unit 13*a*.

In addition, the engine control unit 13 is adapted to have a function for correcting fuel by estimating variations in fuel pressure in the fuel piping 3 based on the fuel pressure in the fuel piping 3 obtained from the output of the fuel pressure detector 22, calculating the amount of fuel supply to the engine 5 based on the difference between the value of estimation and the control pressure of the fuel pressure regulator 7, and controlling the valve opening period of the fuel injection valve 4 so as to obtain the calculated amount of fuel supply.

Also, the fuel correction described above is adapted in such a manner that calculation for fuel correction is performed for a predetermined period for each given cycle synchronously with the timing of starting valve opening of the fuel injection valve 4 in parallel with the calculation of fuel correction by a normal control cycle, and has a controlling function for correcting the result of the above-described normal calculation of fuel correction again during the period when the fuel injection valve 4 is opened.

Subsequently, the operation of the fuel supply system for a vehicle will be described.

First, in a state in which the engine 5 is stopped for a long time as an initial state, the pressure of fuel filled in the fuel piping 3 is lowered due to slight amount of leakage of fuel from a check valve 1*c*, and hence is about ambient pressure (1 kg). When the fuel pump 1 is driven in this state, the fuel pressure in the fuel piping 3 tends to rise to the no-discharge pressure of the pump. On the other hand, since the spring pressure of the spring 8*a* in the fuel pressure regulator 7 is set to the 4.0 kg based on the ambient pressure, the control pressure P0 in the fuel piping 3 by the fuel pressure regulator 7 is 4.0 kg based on the ambient pressure. Then, when fuel continues to flow into the pressure regulating chamber 9 until the fuel pressure in the fuel piping 3 reaches 4.0 kg (control pressure P0) controlled by the fuel pressure regulator 7, and the fuel pressure in the fuel piping 3 exceeds 4.0 kg, the diaphragm 10 is pressed toward the spring chamber 8 against the spring pressure of the spring 8*a*, and the valve body 9*b* moves apart from the discharge port 9*a*. Consequently, fuel is flown back to the fuel tank 2 via the pressure regulating chamber 9 and the return piping 12.

Also, generally, it is known that when fluid flows in its flow channel, pressure loss occurs due to the resistance in the flow channel or the like. This pressure loss is proportionate to the second power of the flow rate as shown in an equation of Bernoulli's principle, for example.

When the flow rate of fuel flown back to the fuel tank 2 via the pressure regulating chamber 9 and the return piping 12 increases, the fuel pressure in the fuel piping 3 increases. The fuel pressure in the fuel piping 3 is monitored by the engine control unit 13 based on the output of the fuel pressure detector 22, and when it is detected that the fuel pressure exceeds 4.0 kg based on the ambient pressure, a DUTY drive signal supplied to the fuel pump control unit 13*c* from the pump control unit 13*a* is set to 0%, and the fuel pump 1 is stopped.

Also, the fuel calculation control unit 13*b* calculates the required amount of fuel supply to the engine 5 based on the output of an air flow sensor 14, performs open-and-close control of the fuel injection valve 4 and supplies fuel to the engine 5.

Since fuel is non-compressible, the fuel pressure in the fuel piping 3 is lowered due to fuel injection from the fuel injection valve 4. Then, when the fuel pressure detector 22 detects that the fuel pressure is lowered to the second set pressure P2, a DUTY drive signal, in which a given DUTY is set, is supplied from the pump control unit 13*a* to the fuel pump control unit 13*c*, and the fuel pump 1 is driven by the discharge amount corresponding to a DUTY drive signal.

Figure 2:
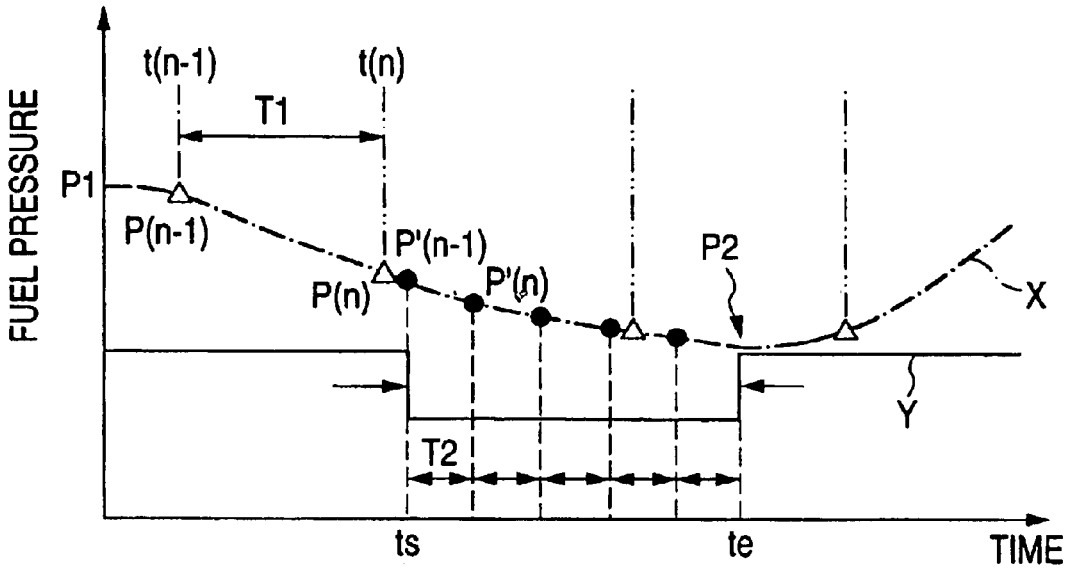
FIG. 2 is an explanatory drawing showing a fuel pressure correcting function according to the first embodiment and a second embodiment of the invention.

Referring now to FIG. 2, a fuel pressure correcting function will be described. FIG. 2 is an explanatory drawing showing correction of fuel pressure in the process of lowering of the fuel pressure during the period that the output of the pressure detector 22 reaches from the first set pressure P1 to the second set pressure P2, and an alternate long and two short dashes line X shows a fuel pressure in the fuel piping 3, and a solid line Y shows a drive pulse of the fuel injection valve.

The fuel pressure in the fuel piping 3 is lowered to the second setting pressure P2 at a speed depending on the operating state of the engine 5 as shown in the drawing. In the process of lowering of the fuel pressure in the fuel piping 3, the engine control unit 13 monitors the fuel pressure in the fuel piping 3 based on the output of the fuel pressure detector 22 at every control cycle T1, and calculates an estimated fuel pressure in the fuel piping 3 from the fuel pressure P(n−1) at the time t(n−1) and the fuel pressure P(n) at the time t(n) in FIG. 2 according to the following equation.

$$PF\text{lead}(n)=PF(n)+KL\{PF(n)-PF(n-1)/T1\}$$

PFlead(n):estimated fuel pressure

PF(n):fuel pressure of this time

PF(n−1):fuel pressure of the previous time

T1:control cycle

KL:correction coefficient

The valve opening period of the fuel injection valve 4 after correction is calculated according to the difference between the estimated fuel pressure PFlead(n) and the control pressure of the fuel pressure regulator 7 according to the following equation to correct the fuel pressure.

$$Tinj_fp=(Tinj-Td)*KFP+Td \quad (1\text{-}1)$$

Tinj_fp: drive period of fuel injection valve after correction of fuel pressure

Tinj: drive period of fuel injection valve before correction of fuel pressure

Td: unproductive time of fuel injection valve

KFP: fuel pressure correction coefficient $$KFP=\sqrt{\text{target fuel pressure (4 kg)}}/\sqrt{PF\text{lead}(n)} \quad (1\text{-}2)$$

PFlead(n): estimated fuel pressure

In parallel with the fuel correction calculation at the above-described normal control cycle T1, the fuel pressure is monitored based on the output of the fuel pressure detector 22 in the fuel piping 3 at every given cycle T2 for a period until the valve opening terminating time te of the fuel injection valve synchronously with the valve opening starting time ts of the fuel injection valve, and correction of the valve opening time is performed again by the same means as the calculation of fuel correction at the normal control cycle described above during the period where the fuel injection valve 4 is opened.

Also, since the operation of the fuel pump 1 can be stopped by providing the fuel pressure detector 22 in the fuel piping 3 and setting the DUTY drive signal supplied from the fuel control unit 13*a* to the fuel pump control unit 13*c* to 0% at the timing when the fuel pressure in the fuel piping 3 reaches the first set pressure P1 which exceeds the control pressure P0 in the fuel piping 3 controlled by the fuel pressure regulator 7, and the discharge amount of the fuel pump 1 can be set arbitrary by supplying a given DUTY drive signal from the fuel control unit 13*a* to the fuel pump control unit 13*c* at the timing when the fuel pressure in the fuel piping 3 is lowered to the second set pressure P2, which is lower than the control pressure P0, it is not necessary to discharge fuel more than the amount of injection required by the engine 5 by the fuel pump 1, and hence power loss may be reduced.

Also, since fuel is discharged at the maximum capacity of the fuel pump 1 when the fuel pump 1 is driven by a simple ON/OFF signal, fuel continues to be flown back uselessly to the fuel tank 2 for a while due to inertia of the pump even after the fuel pressure reaches the first set pressure P1 and the pump is stopped. However, by supplying the given DUTY drive signal from the fuel control unit 13*a* to the fuel pump control unit 13*c* and adjusting the discharging amount of the fuel pump 1 unnecessary flow back of fuel due to inertia of the pump after the pump is stopped can be minimized.

Since the pressure accumulator 30, which has described in the precedent application, is not provided, the development cost of the pressure accumulator 30 or the provision of the space therefor are not necessary, whereby an inexpensive fuel supply system for a vehicle is achieved.

Also, by estimating variations in fuel pressure according to the detected value of the pressure detector 22, calculating fuel correction at a normal control cycle according to the difference between the estimated value and the control pressure of the fuel pressure regulator 7, and correcting the result of calculation of fuel correction again while the fuel injection valve 4 is opened by the calculation of the fuel correction at a given control cycle synchronously with the valve opening starting time of the fuel injection valve 4 in the process of lowering of the fuel pressure in the fuel piping 3 after the fuel pump 1 is stopped, the required amount of fuel supply to the engine 5 is ensured irrespective of the operating state even when the pressure accumulator 30 is not disposed, and hence an adequate control of air-fuel ratio is achieved, thereby preventing occurrence of knocking or the like caused by generation of irregular combustion.

Although the above described first embodiment is adapted to control in such a manner that the operation of the fuel pump 1 is stopped when the fuel pressure in the fuel piping 3 exceeds the first set pressure P1 irrespective of the operating state of the engine 5, since the amount of useless flow back of fuel discharged by the fuel pump 1 is small when the engine 5 is under a high rotational speed and a high load, it is also possible to set a DUTY drive signal to be supplied to the fuel pump control unit 13*c* to 0% and turning the switch relay 13*d* ON to operate the fuel pump 1 continuously.

Second Embodiment

Figure 3:
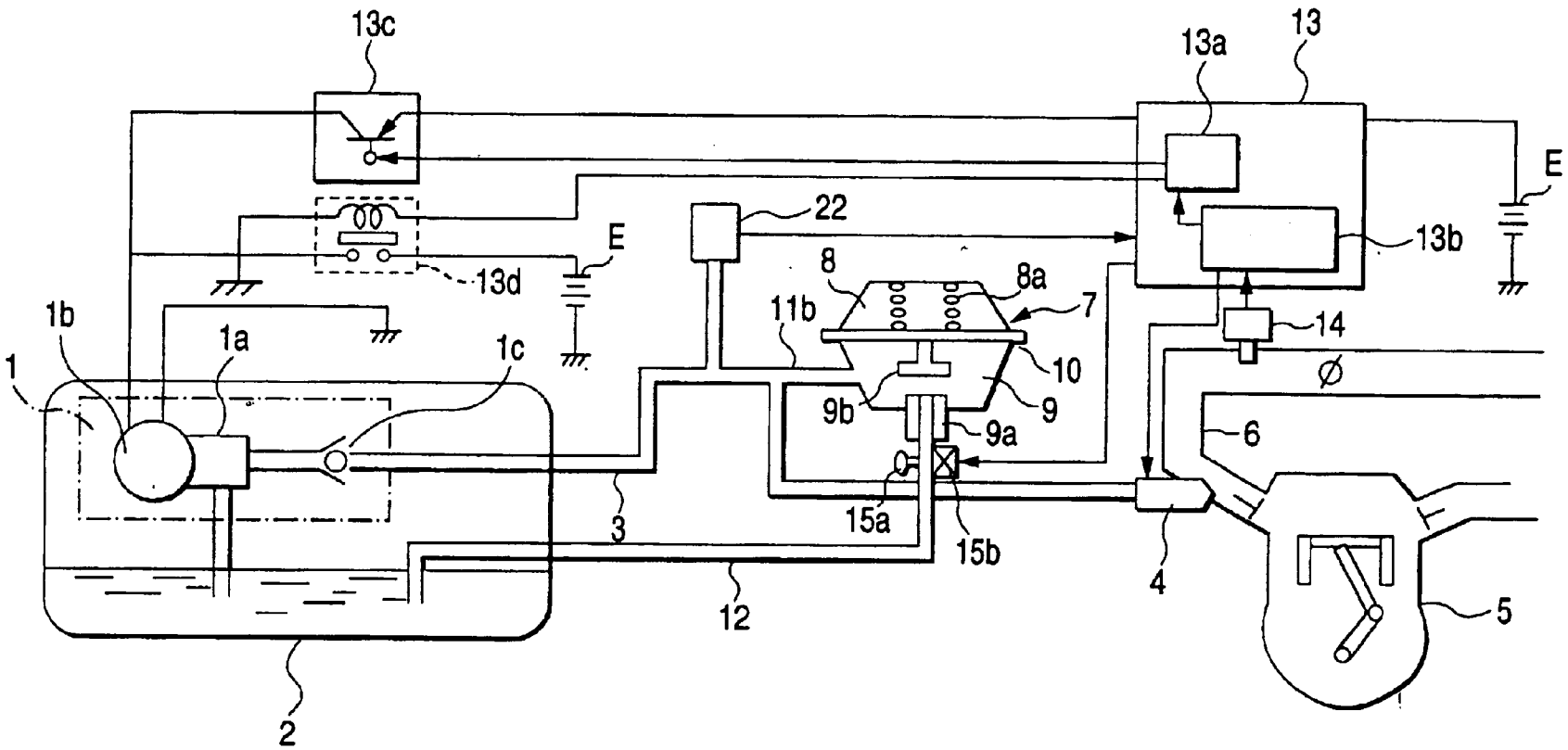
FIG. 3 is a systematic diagram showing the entire structure of the fuel supply system for a vehicle according to the second embodiment of the invention.

Subsequently, referring to the drawings, a second embodiment of the invention will be described. FIG. 3 is a systematic block diagram showing the entire structure of the fuel supply system for a vehicle according to the second embodiment.

In this drawing, the same parts or corresponding parts are designated by the same reference numerals, and description will be omitted. What is different from the system shown in FIG. 1 is that the system includes a valve 15*a* configured to be capable of opening and closing at the fuel flow back port 9*a* of the fuel pressure regulator 7 and a drive unit 15*b* as means for opening and closing the valve, and the drive unit 15*b* is connected to the engine control unit 13 so as to be controlled by an input signal from the engine control unit 13.

Subsequently, referring to FIG. 3, FIG. 4, FIG. 5, and FIG. 6, the operation of the characteristic portion of the second embodiment will be described below.

The fuel flow back port 9*a* of the return piping 12 is closed by the engine control unit 13 during the normal output operation, and fuel is not flown back to the fuel tank 2 at all. When the fuel pump 1 is driven by a given discharging capacity and fuel is filled up in the fuel piping 3, since the fuel flow back port 9*a* of the return piping 12 is closed, and the discharging amount of the fuel pump 1 can be set arbitrary, it is not necessary to discharge fuel by the fuel pump 1 more than the amount of injection required by the engine 5, and hence power loss may be reduced.

When the engine control unit 13 detects that the fuel pressure in the fuel piping 3 exceed the first set pressure P1 (4 kg), the operation of the fuel pump 1 is stopped. Then, the fuel injection valve 4 is opened by the engine control unit 13 and fuel in the fuel piping 3 is supplied to the engine 5.

The fuel pressure in the fuel piping 3 is lowered by this fuel injection. Then, when the engine control unit 13 detects that the fuel pressure in the fuel piping 3 reaches the second set pressure P2, the fuel pump 1 is driven again at a given discharging amount, and it goes back to the initial state in which fuel is filled up in the fuel piping 3.

Figure 4:
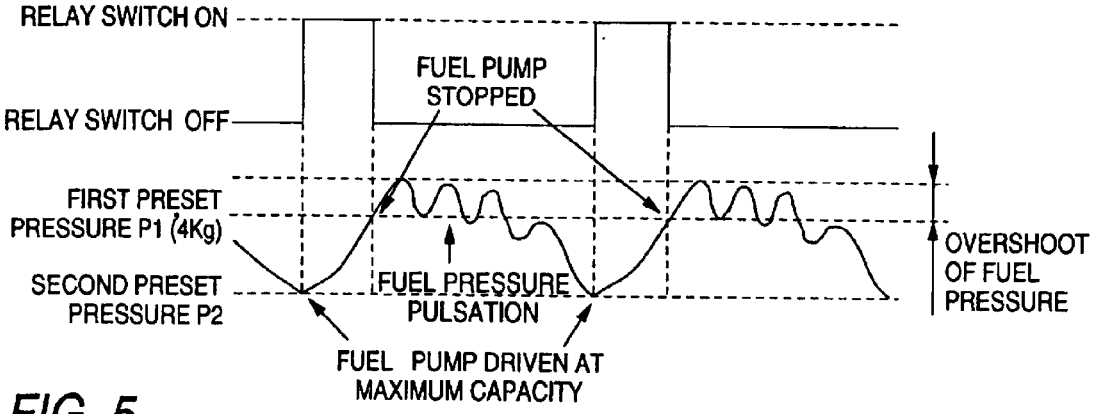
FIG. 4 is an explanatory drawing showing the operation of adjusting the discharging amount of the fuel pump according to the second embodiment of the invention.
Figure 5:
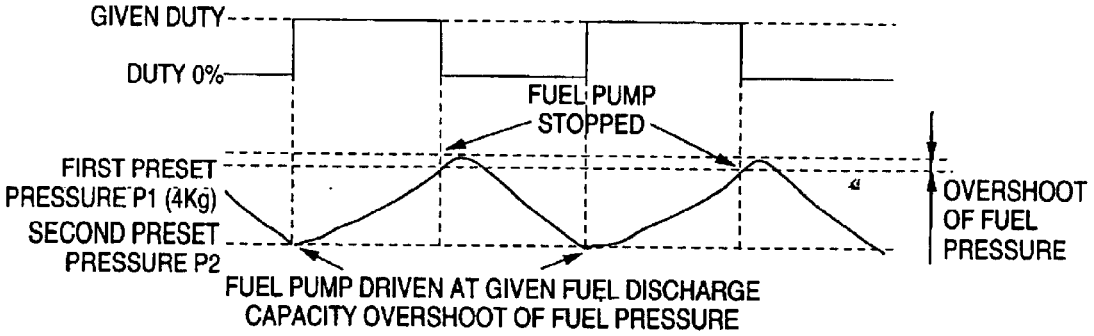
FIG. 5 is an explanatory drawing showing the operation of adjustment of the discharging amount of the fuel pump according to the second embodiment of the invention.

When the fuel pump 1 is driven by a simple ON/OFF signal supplied by the switch relay 13*d* as shown in FIG. 4, fuel is discharged at the maximum capacity of the fuel pump 1, and overshooting of the fuel pressure and the fuel pressure pulsation occur in the fuel piping 3, which is low in resiliency, as shown in the drawings, since the fuel flow back port 9*a* is closed. However, as shown in FIG. 5, by supplying a given DUTY drive signal to the fuel pump control unit 13*c* and adjusting the discharge amount of the fuel pump 1, overshooting of the fuel pressure and the fuel pressure pulsation may be alleviated.

Figure 6:
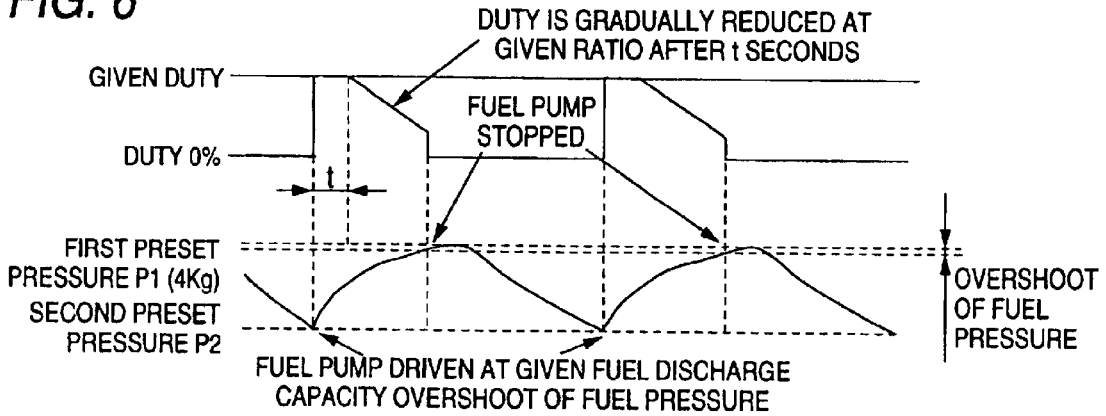
FIG. 6 is an explanatory drawing showing the operation of adjustment of the discharging amount of the fuel pump according to the second embodiment of the invention.
Figure 7:
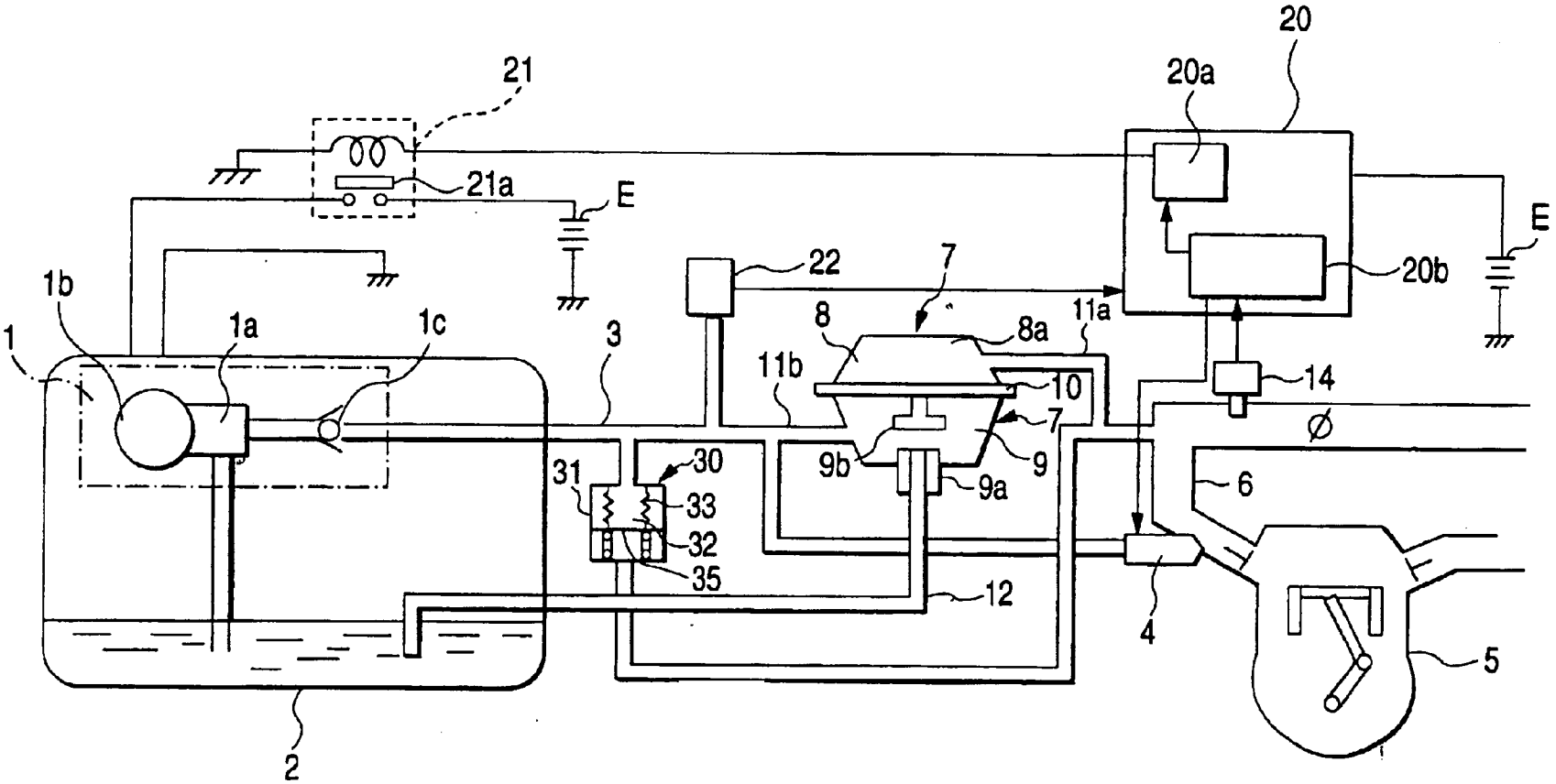
FIG. 7 is a system diagram showing the entire structure of a fuel supply system for a vehicle according to the precedent application.
Figure 8:
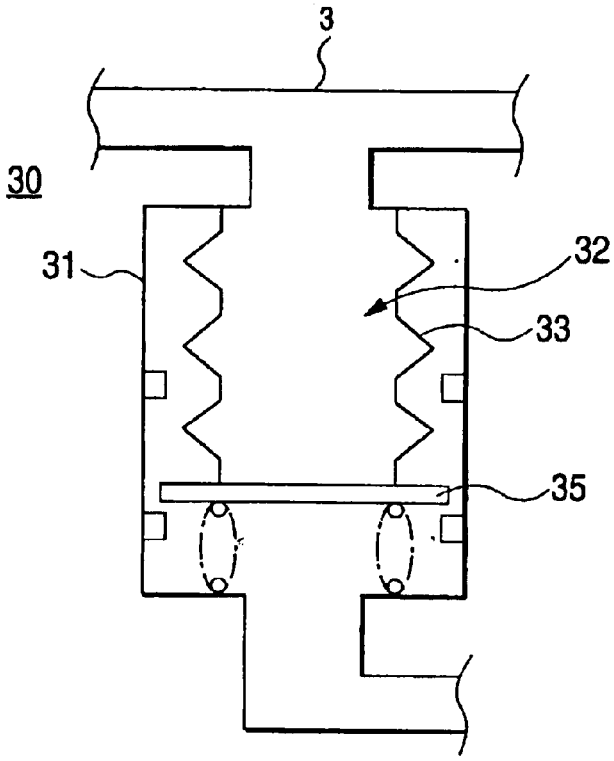
FIG. 8 is a pattern diagram showing the structure of a pressure accumulator of the fuel supply system for a vehicle according to the precedent application.
Figure 9:
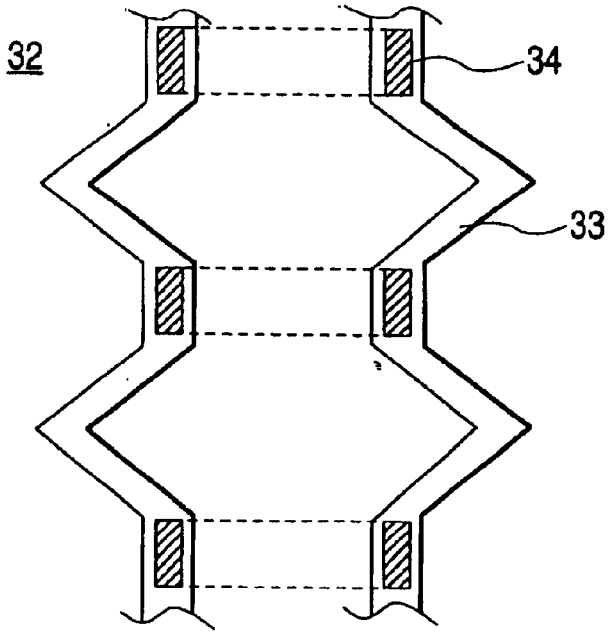
FIG. 9 is a pattern diagram showing the structure of a diaphragm of the pressure accumulator of the fuel supply system for a vehicle according to the precedent application.

It is also possible to alleviate overshooting of the fuel pressure and the fuel pressure pulsation by gradually reducing the above-described DUTY drive signal from an arbitrary set DUTY by a given ratio after t seconds, which is a given period, and adjusting the discharging amount of the fuel pump 1, as shown in FIG. 6.

Also, when the engine 5 is operated under the high revolution and the high load, since the amount of discharged fuel of the fuel pump 1 uselessly flown back is small, the fuel pump 1 can be operated continuously by opening the fuel flow back port 9*a* of the fuel regulator 7 by the valve 15*a* and setting a DUTY drive signal supplied to the fuel pump control unit 13*c* to 0% and turning the switch relay 13*d* ON.

Also, when the fuel back flow port 9*a* of the fuel pressure regulator 7 is closed when the fuel detector 22 is in trouble, since the precise fuel pump control cannot be made, the fuel flow back port 9*a* is opened by the valve 15*a* to operate the fuel pump 1 continuously.

Therefore, the same effects as the first embodiment are achieved according to the second embodiment as well. Although the case in which the DUTY is set to 0% when the fuel pressure exceeds the first set pressure P1 and the fuel pump is stopped has been described above, the operation of the pump may be controlled with a predetermine DUTY capable of securing the quantity which can roughly accommodate the consumed amount of fuel.

What is claimed is:

1. A fuel supply system for a vehicle comprising:

a fuel pump for pumping fuel in a fuel tank to a fuel injection valve via a fuel piping including a check valve;

a fuel pressure regulator for controlling the fuel pressure in the fuel piping to a predetermined control pressure;

a pressure detector for measuring the fuel pressure in the fuel piping; and pump control means for controlling or stopping the operation of the fuel pump by setting a DUTY drive signal supplied to the fuel pump control device to a predetermined DUTY when the output of the pressure detector reaches a first set pressure P1 and setting a DUTY drive signal supplied to the fuel pump control device to a DUTY according to the required amount of fuel discharge when the output of the pressure detector is lowered to a second set pressure P2 which is lower than the first set pressure P1 and the predetermined control pressure of the fuel pressure regulator, so that the fuel pump is driven by a given discharge amount.

2. A fuel supply system for a vehicle according to claim 1, wherein the fuel pressure regulator is adapted to be capable of controlling fuel to be returned to the fuel tank by opening or closing a fuel flow back port.

3. A fuel supply system for a vehicle according to claim 1, comprising fuel correcting means for estimating variations of the fuel pressure based on the fuel pressure in the fuel piping obtained from the output of the pressure detector at every control cycle, calculating the amount of fuel supply to an engine based on the difference between the estimated value and the predetermined control pressure of the fuel pressure regulator, and controlling the valve opening period of the fuel injection valve so that the calculated amount of fuel is obtained.

4. A fuel supply system for a vehicle according to claim 3, wherein the fuel pressure regulator is adapted to be able to control fuel to be returned to the fuel tank by opening or closing the fuel flow back port.

5. A fuel supply system for a vehicle according to claim 3, comprising control means for performing the calculation for fuel correction for a predetermined period until the fuel injection valve is closed in parallel with the calculation for fuel correction for each control cycle and synchronously with the timing of starting the valve opening operation, and correcting the result of calculation for fuel correction at a normal cycle again while the fuel injection valve is opened.

6. A fuel supply system for a vehicle according to claim 5, wherein the fuel pressure regulator is adapted to control fuel to be returned to the fuel tank by opening or closing the fuel flow back port.

* * * * *